US009783948B2

(12) United States Patent
Sun et al.

(10) Patent No.: US 9,783,948 B2
(45) Date of Patent: Oct. 10, 2017

(54) ROOT KEY TYPE PRESSURE BEARING MECHANISM IN ANCHOR HOLE, ROOT KEY TYPE ANCHOR CABLE AND ANCHOR HOLE GROUTING METHOD

(71) Applicant: Institute of Rock and Soil Mechanics, Chinese Academy of Sciences, Wuhan (CN)

(72) Inventors: Guanhua Sun, Wuhan (CN); Hong Zheng, Wuhan (CN); Yongtao Yang, Wuhan (CN); Wei Li, Wuhan (CN)

(73) Assignee: Institute of Rock and Soil Mechanics, Chinese Academy of Sciences, Wuhan (CN)

( * ) Notice: Subject to any disclaimer, the term of this patent is extended or adjusted under 35 U.S.C. 154(b) by 0 days.

(21) Appl. No.: 15/388,432

(22) Filed: Dec. 22, 2016

(65) Prior Publication Data

US 2017/0175354 A1 Jun. 22, 2017

(30) Foreign Application Priority Data

Dec. 22, 2015 (CN) ..... 2015 1 0973544

(51) Int. Cl.

| | |
|---|---|
| ***E02D 5/74*** | (2006.01) |
| ***E02D 5/80*** | (2006.01) |
| ***E01D 11/02*** | (2006.01) |

(52) U.S. Cl.

CPC ..... *E02D 5/808* (2013.01); *E01D 11/02* (2013.01); *E02D 5/80* (2013.01)

(58) Field of Classification Search

CPC ..... E02D 5/80; E02D 5/808; E01D 11/02

(Continued)

(56) References Cited

U.S. PATENT DOCUMENTS 2,357,368 A * 9/1944 Warren ..... B64B 1/005 52/156
3,228,153 A * 1/1966 Luedloff ..... B63B 21/26 52/156

(Continued)

FOREIGN PATENT DOCUMENTS

CN 201650321 A 11/2010
CN 102051878 A 5/2011

(Continued)

*Primary Examiner* — Charles A Fox
*Assistant Examiner* — James Buckle, Jr.
(74) *Attorney, Agent, or Firm* — Platinum Intellectual Property LLP

(57) ABSTRACT

The present invention discloses a root key type pressure bearing mechanism in an anchor hole, a root key type anchor cable and an anchor hole grouting method. The pressure bearing mechanism includes a carrier, root keys and a tapered plug, a through hole is formed in the center of the tapered plug, a taper hole is formed in the center of the carrier, key holes are formed along a radial direction of the carrier with an inner wall of the taper hole as a starting point, the number of the key holes is the same as that of the root keys, the root keys and the key holes constitute sliding pairs, an outer wall of the tapered plug is adapted to the taper hole, the sum of the length of the root key and the radius of a position corresponding to the tapered plug is larger than the radius of the anchor hole, and the length of the root key is less than the radius of the anchor hole; and when the tapered plug is plugged into the taper hole, the head of the root key stretches into a rock mass of the anchor hole. The pressure bearing mechanism assembled by the assembly method is applied to the anchor cable, and when the anchor cable is used for grouting, the anchoring effect of the anchor cable can be effectively improved.

17 Claims, 11 Drawing Sheets

(58) Field of Classification Search
USPC ..... 52/156
See application file for complete search history.

(56) References Cited

U.S. PATENT DOCUMENTS

| | | | | |
|---|---|---|---|---|
| 4,363,198 | A * | 12/1982 | Meyer | E02D 5/80 52/155 |
| 4,502,818 | A | 3/1985 | Elders | |
| 4,884,931 | A | 12/1989 | Revol et al. | |
| 6,189,281 | B1 * | 2/2001 | Sobek | E02D 5/80 405/259.5 |

FOREIGN PATENT DOCUMENTS

| | | | |
|---|---|---|---|
| CN | 102493451 | A | 6/2012 |
| CN | 203188202 | U | 9/2013 |
| CN | 203856403 | U | 10/2014 |
| CN | 104895073 | A | 9/2015 |
| CN | 204676534 | U | 9/2015 |

* cited by examiner

ROOT KEY TYPE PRESSURE BEARING MECHANISM IN ANCHOR HOLE, ROOT KEY TYPE ANCHOR CABLE AND ANCHOR HOLE GROUTING METHOD

RELATED APPLICATIONS

This application is a Non-provisional Application under 35 USC 111(a), which claims Chinese Patent Application Serial No. 201510973544.0, filed Dec. 22, 2015, the disclosure of all of which are hereby incorporated by reference in their entirety.

FIELD OF THE INVENTION

The present invention relates to the technical field of anchoring structure members or wall protection devices, and particularly to a root key type pressure bearing mechanism in an anchor hole, a root key type anchor cable and an anchor hole grouting method.

BACKGROUND OF THE INVENTION

Anchor cable: when a main cable is anchored in a side hole of a suspension bridge, the main cable is divided into multiple strands of steel beams to be respectively anchored in anchors, and these steel beams are referred to as anchor cables. The anchor cable is fixed on a slope surface at an outer end, and the other end thereof is anchored in a stable rock mass in a sliding surface and penetrates through a prestressed steel strand of the sliding surface of a slope to directly generate an anti-skid resistance on the sliding surface, so as to improve the anti-skid friction resistance, and a structural surface is in a pressed state to improve the integrity of the rock mass of the slope, so as to fundamentally improve the mechanical properties of the rock mass, effectively control the displacement of the rock mass, stabilize the rock mass, and achieve the purpose of controlling beddings, landslides, dangerous rocks and dangerous stones.

At present, since the compressive strength of a grouting body is not high enough, in order to prevent the grouting body from being crushed, more pressure dispersion type anchor cables are used on the engineering. The force of the pressure type anchor cable is derived from the bottom of a drill hole, and a cement slurry column bears the pressure from a pressure bearing plate.

More pressure dispersion type anchor cables are used on the engineering, however, the stress mechanisms of the anchor cables in the prior art are approximately similar, anchor cable reinforcement bodies with different lengths are anchored on the pressure bearing plate by setting multiple stages of bearing systems to disperse the stress exerted on the grouting body.

The resistance of these anchor cables is born by the grouting body, and the dispersion type means to disperse the stress of the anchor cables on the grouting body to longitudinal sections along an anchoring force direction. This has high requirements on the strength of the grouting body, and the diameter and the length of an anchoring section need to be increased to improve the effect of the anchoring force. A large amount of concrete needs to be consumed by purely increasing the diameter and the length of the anchoring section, the construction difficulty is larger, and the economic efficiency is low.

SUMMARY OF THE INVENTION

In view of this, the present invention provides a root key type pressure bearing mechanism in an anchor hole, an assembly method thereof, a root key type anchor cable and an anchor hole grouting method, so as to ensure better practicability.

To achieve the first purpose mentioned above, the technical solution of the root key type pressure bearing mechanism in the anchor hole provided by the present invention is as follows:

The root key type pressure bearing mechanism in the anchor hole provided by the present invention includes a carrier, root keys and a tapered plug;

a through hole is formed in the center of the tapered plug, a taper hole is formed in the center of the carrier;

key holes are formed along a radial direction of the carrier with an inner wall of the taper hole as a starting point, and the number of the key holes is the same as that of the root keys, the root keys and the key holes constitute sliding pairs, an outer wall of the tapered plug is adapted to the taper hole, the sum of the length of the root key and the radius of a position corresponding to the tapered plug is larger than the radius of the anchor hole, and the length of the root key is less than the radius of the anchor hole; and when the tapered plug is plugged into the taper hole, the head of the root key stretches into a rock mass of the anchor hole.

To achieve the second purpose mentioned above, the technical solution of the root key type anchor cable provided by the present invention is as follows:

The root key type anchor cable provided by the present invention includes an anchor platform, an anchor device, a plurality of pressure bearing mechanisms provided by the present invention and multiple groups of reinforcement bodies, the anchor device is fixedly connected to the anchor platform to constitute an outer anchoring section, the plurality of pressure bearing mechanisms are respectively connected with the multiple groups of reinforcement bodies in series, fixing ends of the reinforcement bodies are respectively connected to the outer anchoring section in parallel, hanging ends of the reinforcement bodies are used for hanging the pressure bearing mechanisms, the plurality of pressure bearing mechanisms are externally provided with a plurality of root keys which can stretch into a rock mass of an anchor hole along the radial direction, through holes are formed in the centers of the plurality of pressure bearing mechanisms, circle centers of the through holes are located on the same straight line, and the diameters of the through holes are the same, a punch hole is reserved in the outer anchoring section, the punch hole is located on the same straight line as the circle centers of the through holes, and the diameter of the punch hole is the same as the diameters of the through holes, a grouting pipe penetrates through the punch hole and the through holes, and the grouting pipe constitutes sliding pairs with the pressure bearing mechanisms and the outer anchoring section.

To achieve the third purpose mentioned above, the technical solution of the anchor hole grouting method provided by the present invention is as follows:

The anchor hole grouting method provided by the present invention is achieved on the basis of the root key type anchor cable provided by the present invention, the plurality of pressure bearing mechanisms sequentially include a first pressure bearing mechanism, a second pressure bearing mechanism, a third pressure bearing mechanism, . . . and an $N^{th}$ pressure bearing mechanism from bottom to top, and the anchor hole grouting method includes the following steps:

assembling the first pressure bearing mechanism, the second pressure bearing mechanism, the third pressure bearing mechanism, . . . and the $N^{th}$ pressure bearing mechanism in sequence, and locating a grout outlet of the grouting pipe at the bottom of the first pressure bearing mechanism;

injecting a grouting body to the bottom of the first pressure bearing mechanism from the grouting pipe, and gradually lifting the grout outlet of the grouting pipe in a grouting process until the bottom of the first pressure bearing mechanism is filled with the grouting body, wherein the grout outlet of the grouting pipe is lifted to a space between the first pressure bearing mechanism and the second pressure bearing mechanism;

continuing to inject the grouting body to the space between the first pressure bearing mechanism and the second pressure bearing mechanism from the grouting pipe, and gradually lifting the grout outlet of the grouting pipe in the grouting process until the space between the first pressure bearing mechanism and the second pressure bearing mechanism is filled with the grouting body, wherein the grout outlet of the grouting pipe is lifted to a space between the second pressure bearing mechanism and the third pressure bearing mechanism;

continuing to inject the grouting body to the space between the second pressure bearing mechanism and the third pressure bearing mechanism from the grouting pipe, and gradually lifting the grout outlet of the grouting pipe in the grouting process until the space between the second pressure bearing mechanism and the third pressure bearing mechanism is filled with the grouting body, wherein the grout outlet of the grouting pipe is lifted to a space above the third pressure bearing mechanism;

repeating the operation until the space between the $(N-1)^{th}$ pressure bearing mechanism and the $N^{th}$ pressure bearing mechanism is filled with the grouting body, wherein the grout outlet of the grouting pipe is lifted to a space above the $N^{th}$ pressure bearing mechanism;

continuing to inject the grouting body to the space above the $N^{th}$ pressure bearing mechanism, and gradually lifting the grout outlet of the grouting pipe in the grouting process until the anchoring section of the anchor hole is filled with the grouting body, wherein the grout outlet of the grouting pipe is lifted to a free section of the anchor hole; and continuing to lift the grout outlet of the grouting pipe until the grouting pipe is removed from the anchor platform and the anchor device, and the grouting process of the anchor hole is completed.

According to the root key type anchor cable provided by the present invention and the anchor hole grouting method achieved on the basis of the root key type anchor cable, the root key type pressure bearing mechanism in the anchor hole provided by the present invention is adopted. After the anchor hole grouting process is completed, since the plurality of pressure bearing mechanisms are provided with the plurality of root keys which can stretch into the rock mass of the anchor hole, the effective bearing areas of the pressure bearing mechanisms actually exceed the areas of the upper surfaces thereof, meanwhile, the root keys generate interactive forces with the rock mass in the anchor hole, therefore the resistance of the anchoring section can be improved, in this way, after the anchor hole grouting engineering is completed by adopting the anchor cable and the grouting method provided by the present invention, the anchoring effect of the anchor cable can be effectively improved.

BRIEF DESCRIPTION OF THE DRAWINGS

By reading detailed description of preferred embodiments below, various other advantages and beneficial effects will become clear to those of ordinary skill in the art. The accompanying drawings are merely used for showing the preferred embodiments, but cannot be deemed as limitations to the present invention. Moreover, in the entire accompanying drawing, identical reference signs represent identical components. In the accompanying drawings.

DETAILED DESCRIPTION OF THE EMBODIMENTS

Figure 1:
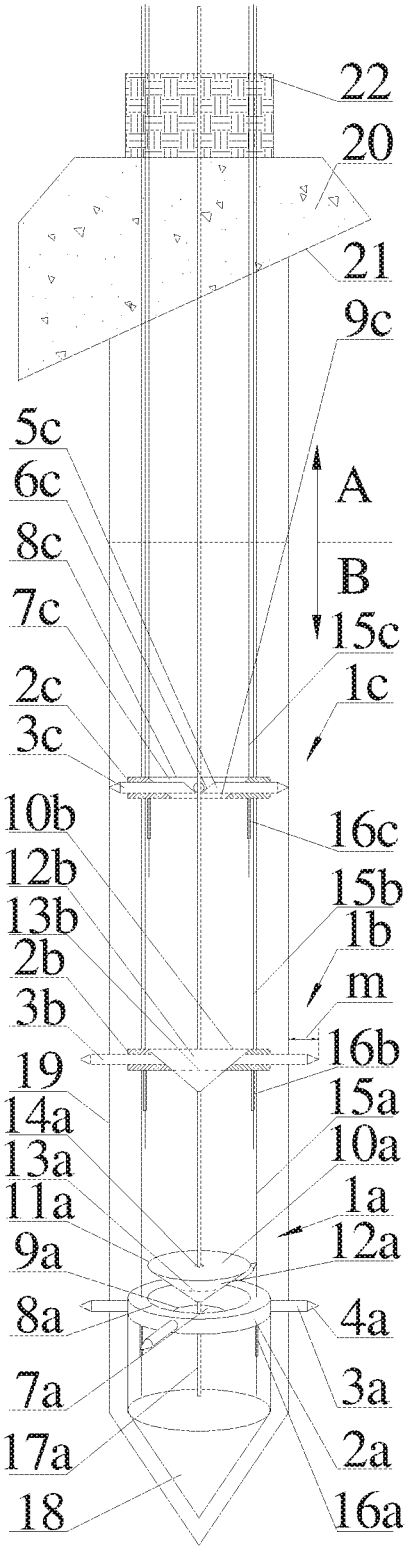
FIG. 1 is a schematic diagram of a general structure of a root key type anchor cable provided by embodiment 1 of the present invention.
Figure 2A:
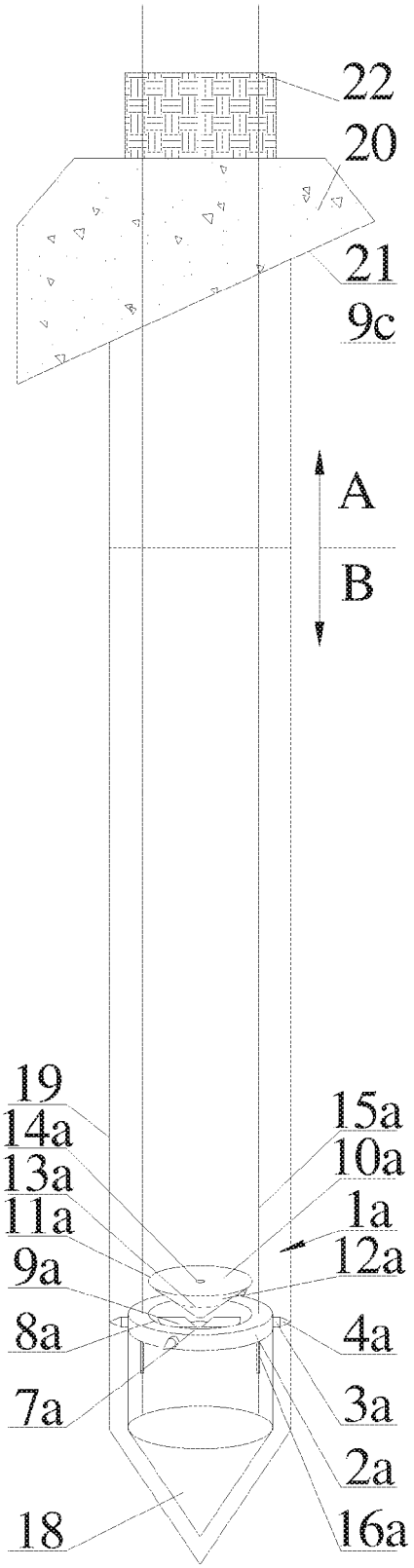
FIG. 2*a* is a structural schematic diagram of the root key type anchor cable provided by embodiment 1 of the present invention, when a grouting pipe is mounted in a first manner and when a first pressure bearing mechanism is mounted.
Figure 2B:
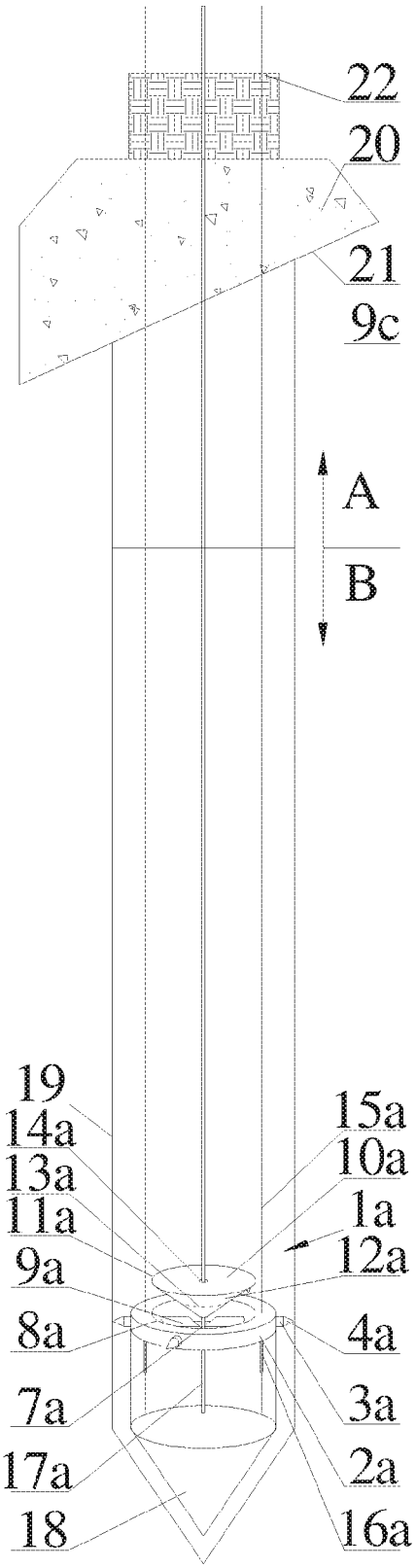
FIG. 2*b* is a structural schematic diagram of the root key type anchor cable provided by embodiment 1 of the present invention, when the grouting pipe is mounted in a second manner and when the first pressure bearing mechanism is mounted.
Figure 3A:
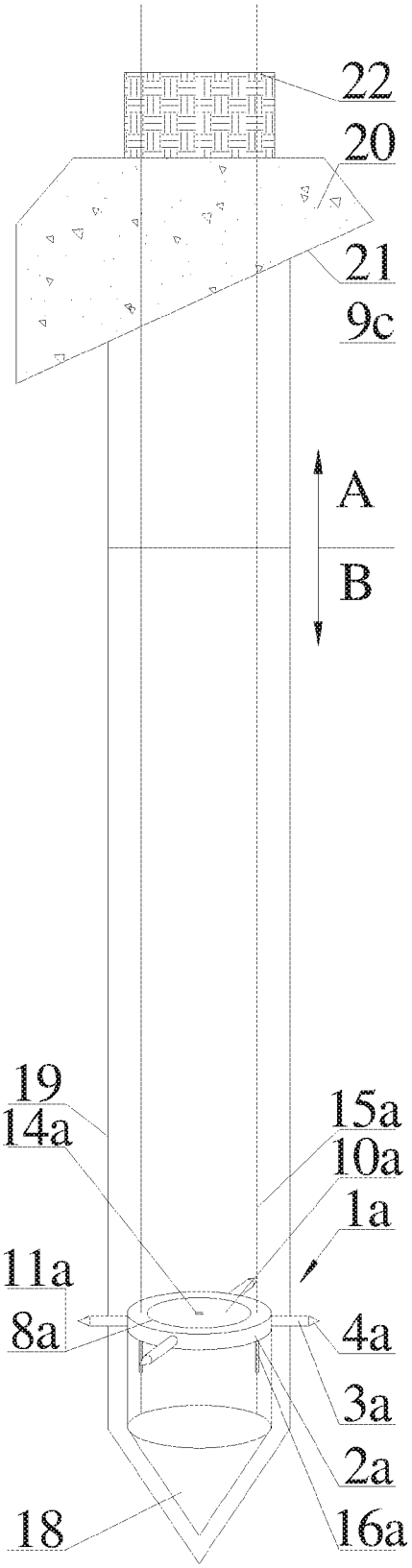
FIG. 3*a* is a structural schematic diagram of the root key type anchor cable provided by embodiment 1 of the present invention, when the grouting pipe is mounted in the first manner and when the mounting of the first pressure bearing mechanism is completed.
Figure 3B:
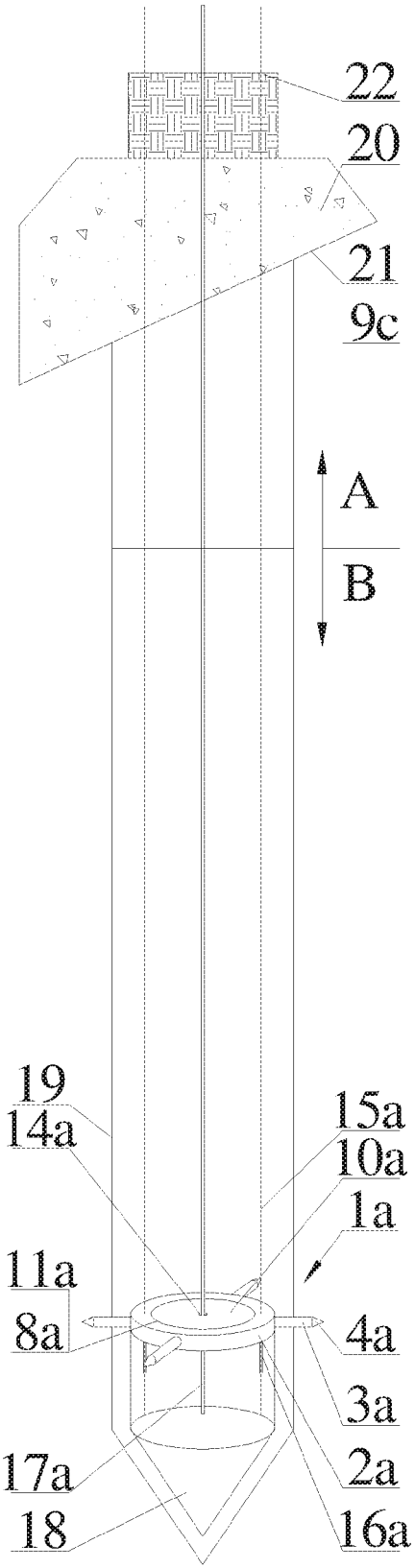
FIG. 3*b* is a structural schematic diagram of the root key type anchor cable provided by embodiment 1 of the present invention, when the grouting pipe is mounted in the second manner and when the mounting of the first pressure bearing mechanism is completed.
Figure 4A:
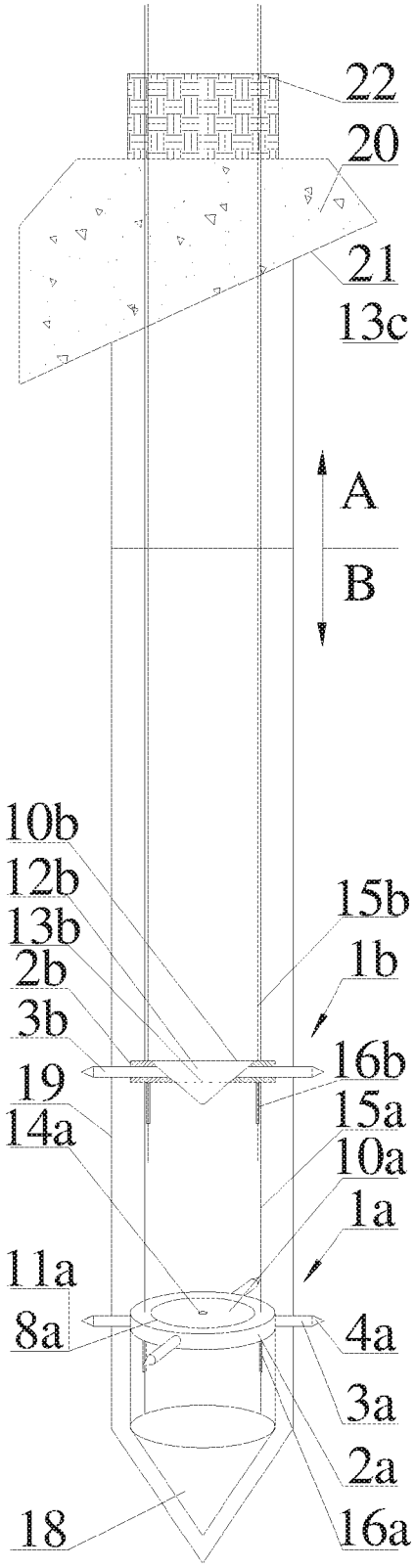
FIG. 4*a* is a structural schematic diagram of the root key type anchor cable provided by embodiment 1 of the present invention, when the grouting pipe is mounted in the first manner and when the mounting of a second pressure bearing mechanism is completed.
Figure 4B:
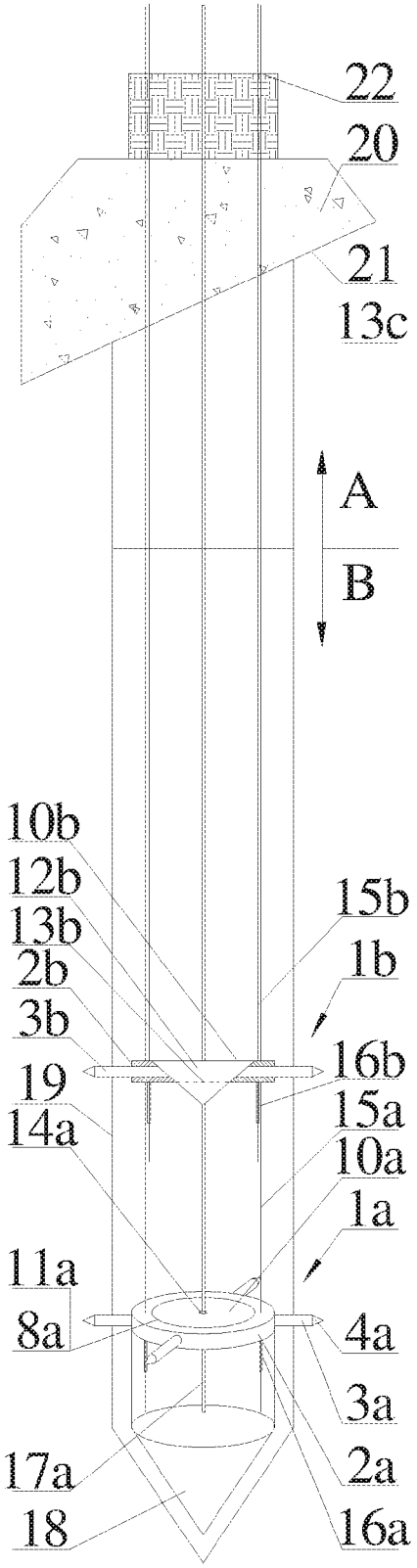
FIG. 4*b* is a structural schematic diagram of the root key type anchor cable provided by embodiment 1 of the present invention, when the grouting pipe is mounted in the second manner and when the mounting of the second pressure bearing mechanism is completed.
Figure 5A:
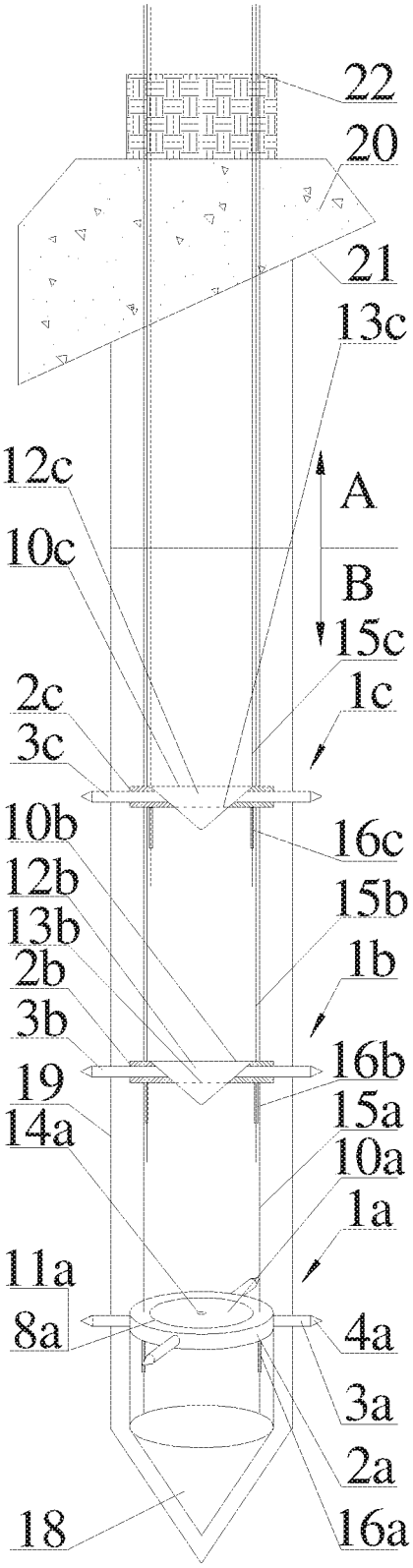
FIG. 5*a* is a structural schematic diagram of the root key type anchor cable provided by embodiment 1 of the present invention, when the grouting pipe is mounted in the first manner and when the mounting of a third pressure bearing mechanism is completed.
Figure 5B:
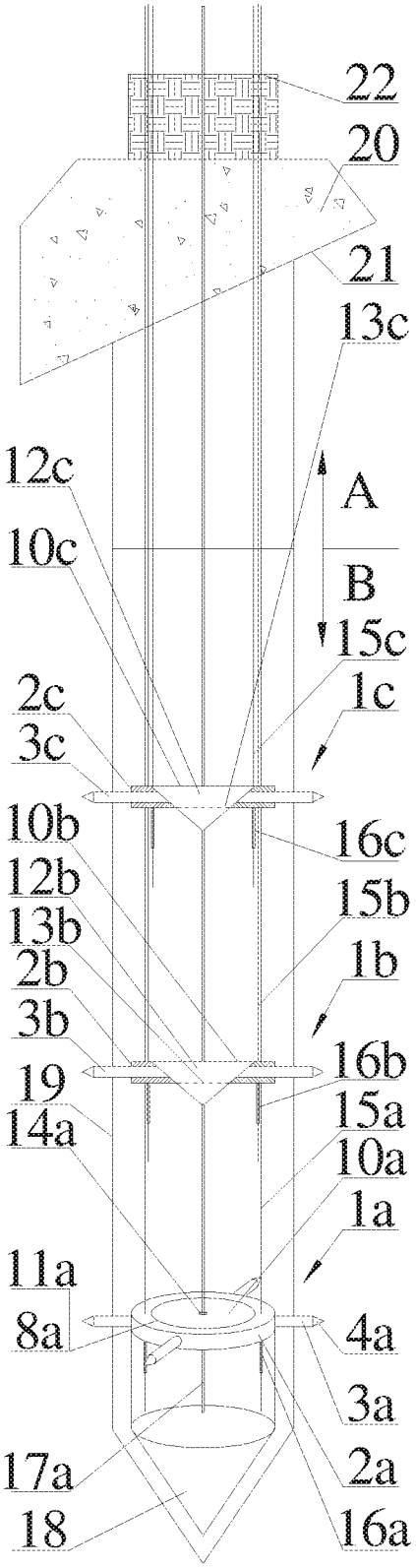
FIG. 5*b* is a structural schematic diagram of the root key type anchor cable provided by embodiment 1 of the present invention, when the grouting pipe is mounted in the second manner and when the mounting of the third pressure bearing mechanism is completed.
Figure 6:
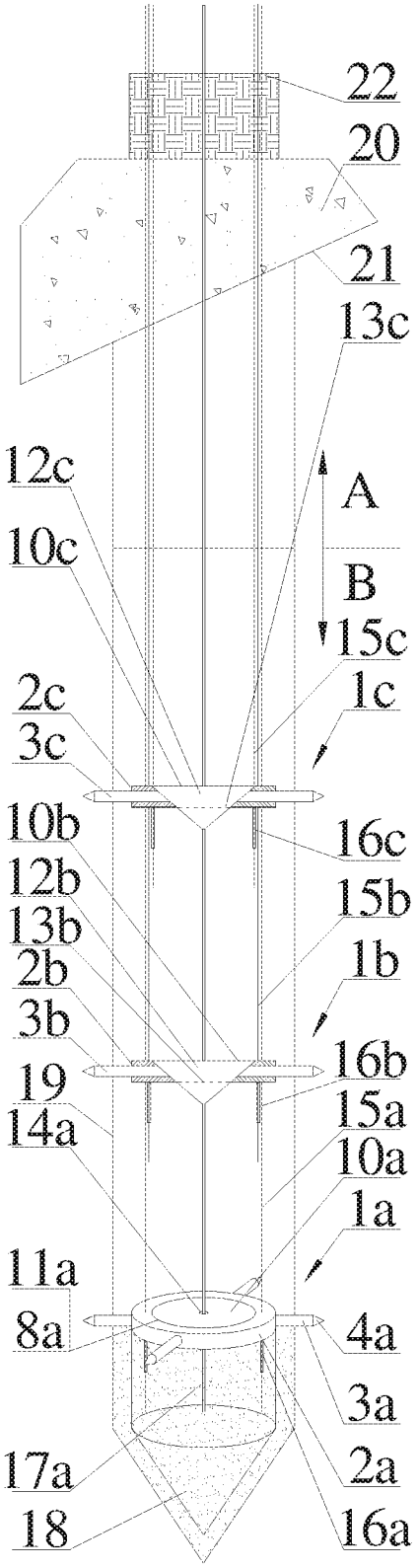
FIG. 6 is a structural schematic diagram of the root key type anchor cable provided by embodiment 1 of the present invention, when a grout outlet of the grouting pipe is located at the bottom of the first pressure bearing mechanism and the bottom of the first pressure bearing mechanism is filled with the grouting body.
Figure 7:
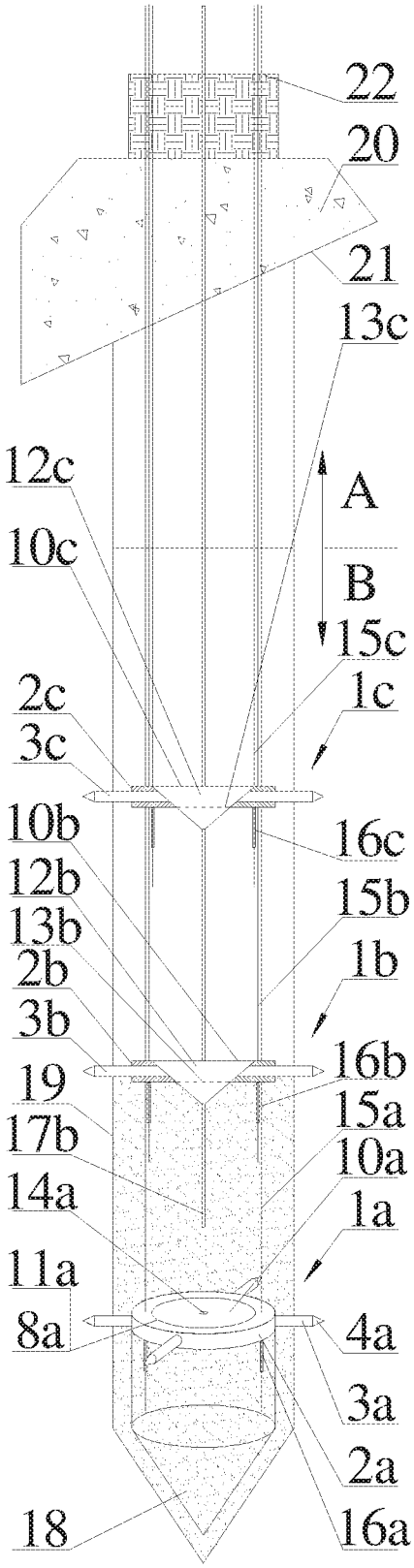
FIG. 7 is a structural schematic diagram of the root key type anchor cable provided by embodiment 1 of the present invention, when the grout outlet of the grouting pipe is located between the first pressure bearing mechanism and the second pressure bearing mechanism and when the space between the first pressure bearing mechanism and the second pressure bearing mechanism is filled with the grouting body.
Figure 8:
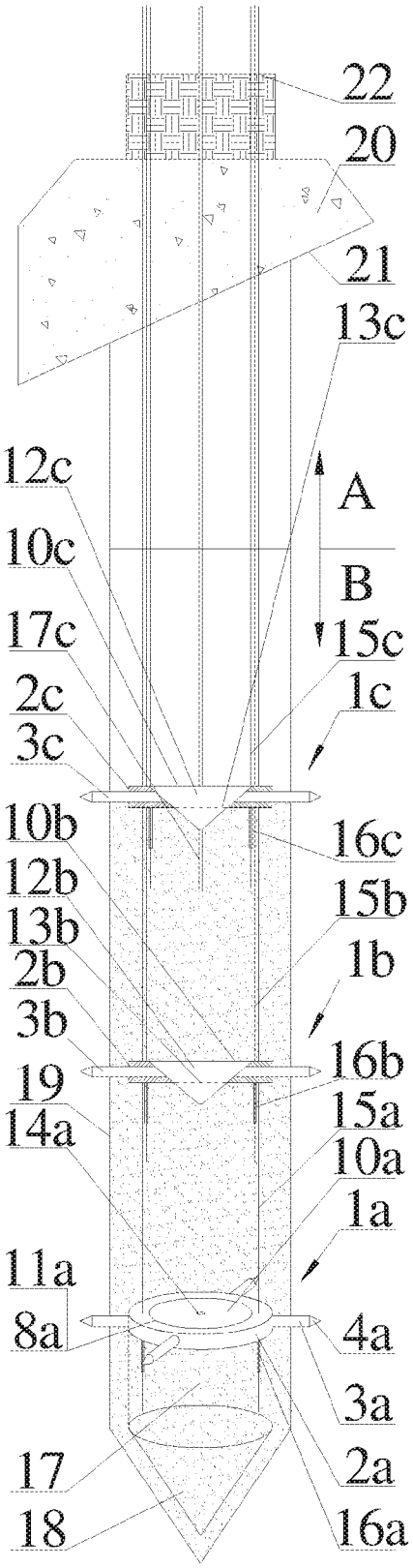
FIG. 8 is a structural schematic diagram of the root key type anchor cable provided by embodiment 1 of the present invention, when the grout outlet of the grouting pipe is located between the second pressure bearing mechanism and the third pressure bearing mechanism and when the space between the second pressure bearing mechanism and the third pressure bearing mechanism is filled with the grouting body.
Figure 9:
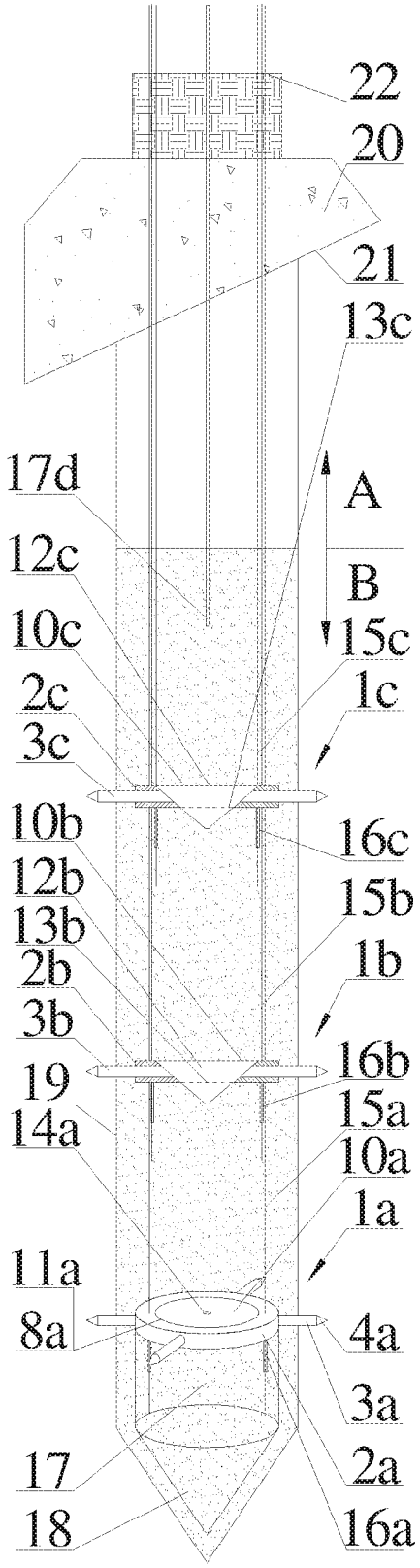
FIG. 9 is a structural schematic diagram of the root key type anchor cable provided by embodiment 1 of the present invention, when the grout outlet of the grouting pipe is located above the third pressure bearing mechanism and when an anchoring section of an anchor hole is filled with the grouting body on the whole.

To solve the problems in the prior art, the present invention provides a root key type pressure bearing mechanism in an anchor hole, an assembly method thereof, a root key type anchor cable and an anchor hole grouting method, so as to ensure better practicability.

To further illustrate technical means adopted to achieve predetermined inventive purposes and effects in the present invention, specific implementations, structures, features and effects of the root key type pressure bearing mechanism in the anchor hole, the assembly method thereof, the root key type anchor cable and the anchor hole grouting method provided by the present invention will be illustrated below in detail in combination with the accompanying drawings and preferred embodiments. In the illustration below, different "one embodiment" or "embodiments" do not necessarily mean the same embodiment. In addition, specific features, structures or features in one or three embodiments may be combined in any suitable form.

The term "and/or" in this paper is merely an association relationship describing associated objects and represents that three relationships may exist. For example, A and/or B is specifically understood as including any one of the following three situations: A and B may simultaneously exist, A may singly exist and B may also singly exist.

For the convenience of illustration, in the root key type anchor cable provided by the embodiment of the present invention, three pressure bearing mechanisms and three groups of reinforcement bodies are provided, wherein when a mark number 1 represents the pressure bearing mechanisms, the mark number 1*a* represents the first pressure bearing mechanism, the mark number 1*b* represents the second pressure bearing mechanism, and the mark number 1*c* represents the third pressure bearing mechanism, and so on.

Embodiment 1

Referring to FIG. 1 to FIG. 10, the root key type anchor cable provided by embodiment 1 of the present invention includes an anchor platform 21, an anchor device 22, three pressure bearing mechanisms 1*a*, 1*b*, 1*c* and three groups of reinforcement bodies 15*a*, 15*b*, 15*c*, the anchor device 22 is fixedly connected to the anchor platform 20 to constitute an outer anchoring section, the three pressure bearing mechanisms 1*a*, 1*b*, 1*c* are respectively connected with the three groups of reinforcement bodies 15*a*, 15*b*, 15*c* in series, fixing ends of the reinforcement bodies 15*a*, 15*b*, 15*c* are respectively connected to the outer anchoring section in parallel, hanging ends of the reinforcement bodies 15*a*, 15*b*, 15*c* are used for hanging the pressure bearing mechanisms 1*a*, 1*b*, 1*c*, each one of the pressure bearing mechanisms 1*a*, 1*b*, 1*c* is externally provided with a plurality of root keys 3*a*, 3*b*, 3*c* which can stretch into a rock mass of an anchor hole along the radial direction, through holes 14*a*, 14*b* (not labeled in the figures), 14*c* (not labeled in the figures) are formed in the centers of the three pressure bearing mechanisms 1*a*, 1*b*, 1*c*, circle centers of the through holes 14*a*, 14*b* (not labeled in the figures), 14*c* (not labeled in the figures) are located on the same straight line, the diameters of the through holes 14*a*, 14*b* (not labeled in the figures), 14*c* (not labeled in the figures) are the same, a punch hole is reserved in the outer anchoring section, the punch hole is located on the same straight line as the circle centers of the through holes 14*a*, 14*b* (not labeled in the figures), 14*c* (not labeled in the figures), the diameter of the punch hole is the same as the diameters of the through holes 14*a*, 14*b* (not labeled in the figures), 14*c* (not labeled in the figures), a grouting pipe penetrates through the punch hole and the through holes 14*a*, 14*b* (not labeled in the figures), 14*c* (not labeled in the figures), and the grouting pipe constitutes sliding pairs with the pressure bearing mechanisms 1*a*, 1*b*, 1*c* and the outer anchoring section. In FIG. 1 to FIG. 10, an A part represents a free section, and a B part represents an anchoring section.

According to the root key type anchor cable provided by the present invention, since the plurality of pressure bearing mechanisms 1*a*, 1*b*, 1*c* are provided with the plurality of root keys 3*a*, 3*b*, 3*c* which can stretch into the rock mass of the anchor hole 19, the effective bearing areas of the pressure bearing mechanisms 1*a*, 1*b*, 1*c* actually exceed the areas of the upper surfaces thereof, meanwhile, the root keys 3*a*, 3*b*, 3*c* generate interactive forces with the rock mass in the anchor hole 19, therefore the resistance of the anchoring section B can be improved, and accordingly the root key type anchor cable provided by the present invention can effectively improve the anchoring effect of the anchor cable.

Referring to FIG. 1 to FIG. 17, the pressure bearing mechanism includes a carrier 2, root keys 3 and a tapered plug 10, a through hole is formed in the center of the tapered plug 10, a taper hole 7 is formed in the center of the carrier 2, key holes are formed along a radial direction of the carrier 2 with an inner wall of the taper hole 7 as a starting point, the number of the key holes is the same as that of the root keys 3, the root keys 3 and the key holes constitute sliding pairs, and an outer wall of the tapered plug 10 is adapted to the taper hole 7. The sum of the length of the root key 3 and the radius of a position corresponding to the tapered plug 10 is larger than the radius of the anchor hole 19, so as to guarantee that after the tapered plug 10 is plugged into the taper hole 7, the head of the root key 3 protrudes from the outer wall of the carrier 2; the length of the root key 3 is less than the radius of the anchor hole 19, when the pressure bearing mechanism needs to be conveyed into the anchor hole 19, in a conveyance process, the diameter of the outermost circle of each root key 3 must be not larger than the diameter of the anchor hole to guarantee the barrier-free pass of the pressure bearing mechanism in the anchor hole 19; and when the tapered plug 10 is plugged into the anchor hole 19, the head 4 of the root key 3 stretches into a rock mass of the anchor hole 19, so that the root key 3 can head for the interior of the rock mass of the anchor hole 19 to generate an interactive force.

Figure 11:
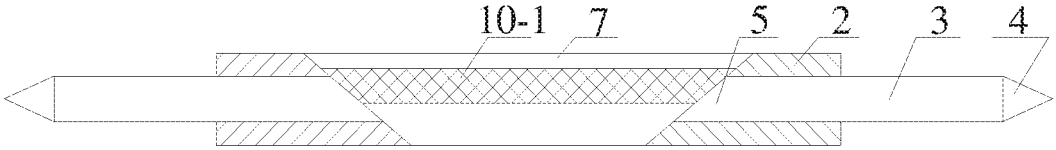
FIG. 11 is a schematic diagram of the first cooperation relationship of a tapered plug and a carrier of the root key type anchor cable provided by embodiment 1 of the present invention.

Referring to FIG. 11, the diameter of the top of a tapered plug 10-1 is larger than the diameter of the bottom of the taper hole 7 to prevent the tapered plug 10-1 from leaking from the taper hole, and when the tapered plug 10-1 is plugged into the taper hole 7, the bottommost end of the tapered plug 10-1 is overlapped with the key hole, so as to guarantee that the tapered plug 10-1 can apply a centrifugal acting force to the root key 3 to cause the root key 3 to head for the interior of the rock mass of the anchor hole 19.

Figure 12:
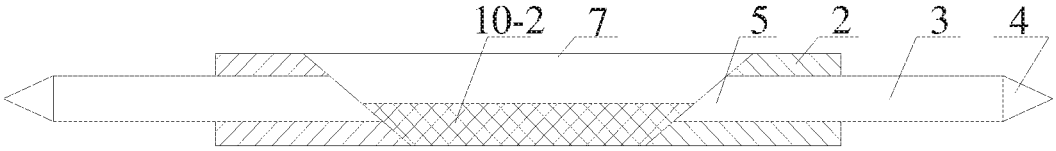
FIG. 12 is a schematic diagram of the second cooperation relationship of the tapered plug and the carrier of the root key type anchor cable provided by embodiment 1 of the present invention.

Referring to FIG. 12, the diameter of the top of a tapered plug 10-2 is larger than the diameter of the bottom of the taper hole 7 to prevent the tapered plug 10-2 from leaking from the taper hole, and when the tapered plug 10-2 is plugged into the taper hole 7, the topmost end of the tapered plug 10-2 is overlapped with the key hole, so as to guarantee that the tapered plug 10-2 can apply a centrifugal acting force to the root key 3 to cause the root key 3 to head for the interior of the rock mass of the anchor hole 19.

Figure 13:
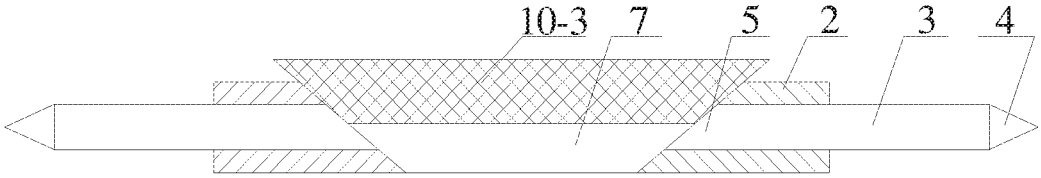
FIG. 13 is a schematic diagram of the third cooperation relationship of the tapered plug and the carrier of the root key type anchor cable provided by embodiment 1 of the present invention.

Referring to FIG. 13, the diameter of the top of a tapered plug 10-3 is not less than the diameter of the top of the taper hole 7, and when the tapered plug 10-3 is plugged into the taper hole, the bottommost end of the tapered plug 10-3 is overlapped with the key hole, so as to guarantee that the tapered plug 10-3 can apply a centrifugal acting force to the root key 3 to cause the root key 3 to head for the interior of the rock mass of the anchor hole 19.

Figure 14:
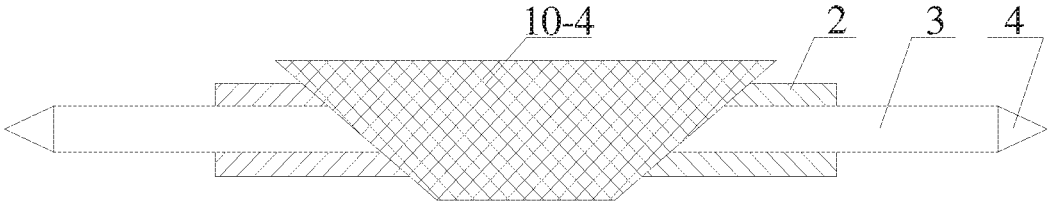
FIG. 14 is a schematic diagram of the fourth cooperation relationship of the tapered plug and the carrier of the root key type anchor cable provided by embodiment 1 of the present invention.

Referring to FIG. 14, the diameter of the top of a tapered plug 10-4 is larger than the diameter of the top of the taper hole 7, and when the tapered plug 10-4 is plugged into the taper hole 7, the tapered plug 10-4 completely covers the key hole, so as to guarantee that the tapered plug 10-4 can apply a centrifugal acting force to the root key 3 to cause the root key 3 to head for the interior of the rock mass of the anchor hole 19.

Figure 15:
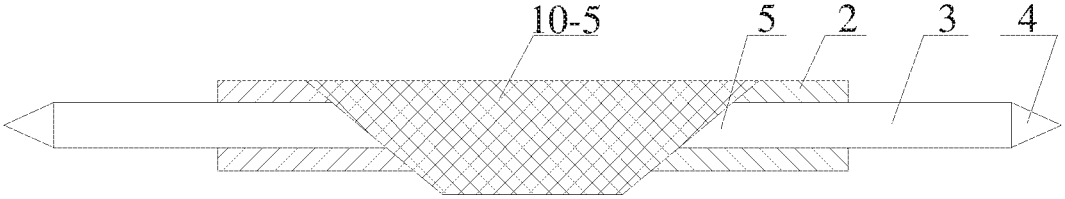
FIG. 15 is a schematic diagram of the fifth cooperation relationship of the tapered plug and the carrier of the root key type anchor cable provided by embodiment 1 of the present invention.

Referring to FIG. 15, the diameter of the top of a tapered plug 10-5 is equal to the diameter of the top of the taper hole 7, and when the tapered plug 10-5 is plugged into the taper hole 7, the top face of the tapered plug 10-5 and the upper surface of the carrier 2 constitute a plane, at this time, the bearing surface of the pressure bearing mechanism is also a plane, thereby not lessening the actual bearing area of the pressure bearing mechanism and generating no stress concentration; and the tapered plug 10-5 completely covers the key hole, so as to guarantee that the tapered plug 10-5 can apply a centrifugal acting force to the root key 3 to cause the root key 3 to head for the interior of the rock mass of the anchor hole 19.

The height of the tapered plug 10 is not less than the height of the taper hole 7, referring to FIG. 14 to FIG. 17, in this case, there is no remaining space between the tapered plug 10 and the taper hole 7, therefore in a grouting process, grouting spaces can be guaranteed to be filled with the grouting body to avoid the problem of reduced bearing capacity caused by the remaining space. In the embodiment, a circular section 13*a* of a tapered plug 10*a* is flush with the bottom surface of a carrier 2*a*, a circular section 13*b* of a tapered plug 10*b* is flush with the bottom surface of a carrier 2*b*, and a circular section 13*c* of a tapered plug 10*c* is flush with the bottom surface of a carrier 2*c*.

The head of the root key 3 has a pointed end 4, in this case, according to $F=P\times S$, wherein F represents an acting force, P represents a pressure and S represents a stressed area, and when the root key 3 stretches into the rock mass of the anchor hole 19 due to the centrifugal acting force of the tapered plug 10, the pressure is larger, so that the root key 3 heads for the rock mass of the anchor hole 19 in a more time-saving, more labor-saving and more convenient manner.

Figure 16:
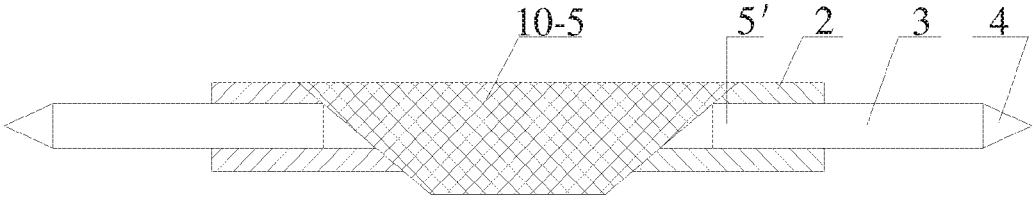
FIG. 16 is a schematic diagram of the fifth cooperation relationship of the tapered plug and the carrier of the root key type anchor cable provided by embodiment 1 of the present invention (wherein, the tail of a root key is cylindrical)

Referring to FIG. 15, the shape of a tail 5 of the root key 3 is adapted to the shape of the outer wall of the tapered plug 10-5, and thus the tail 5 of the root key 3 and the outer wall of the tapered plug 10-5 form surface contact. In this case, the stressed area of the centrifugal acting force applied by the tapered plug 10-5 to the root key 3 is larger, and the stress is more uniform. If the tail 5' of the root key 3 is made into a cylinder according to the manner as shown in FIG. 16, at this time, the tail 5' of the root key 3 and the outer wall of the tapered plug 10-5 form point contact, and thus adverse consequences of a stress concentration effect and inconsistent stress of the root key 3 are generated easily. Moreover, a pore will be reserved between the tapered plug 10-5 and the root key 3, so that the root key 3 cannot fully fill the key hole, which reduces the anchoring effect.

Figure 17:
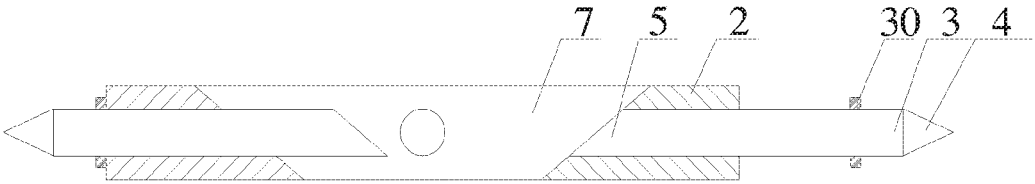
FIG. 17 is a schematic diagram of the fifth cooperation relationship of the tapered plug and the carrier of the root key type anchor cable provided by embodiment 1 of the present invention (wherein, the root key is fixedly connected with a blocking part at a contact site with an outer wall of the carrier)

Referring to FIG. 17, the root key 3 is fixedly connected with a blocking part 30 at a contact site with the outer wall of the carrier 2. The function of the blocking part 30 is as follows: in a centripetal movement of the root key 3 relative to the taper hole 7, when the blocking part 30 props against the outer wall of the carrier 2, the root key 3 cannot continue to carry out centripetal movement relative to the taper hole 7, and thus the root key 3 can be prevented from dropping from the taper hole 7.

The blocking part 30 is made of a flexible material. In this case, when the root key 3 heads for the rock mass of the anchor hole 19, since the blocking part 30 is made of the flexible material, no additional resistance brought by the blocking part 30 will occur.

Figure 18:
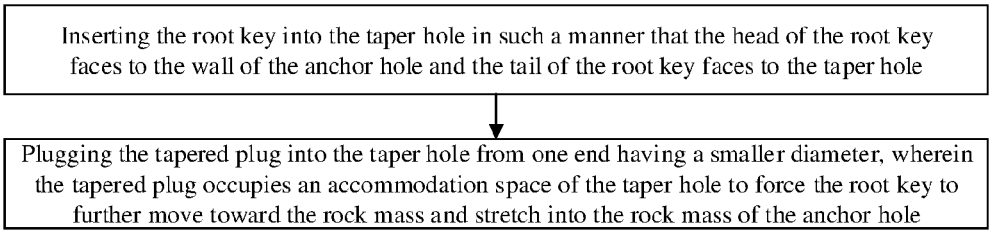
FIG. 18 is a flowchart of steps of an assembly method of pressure bearing mechanisms used in the root key type anchor cable provided by embodiment 1 of the present invention.
Figure 19:
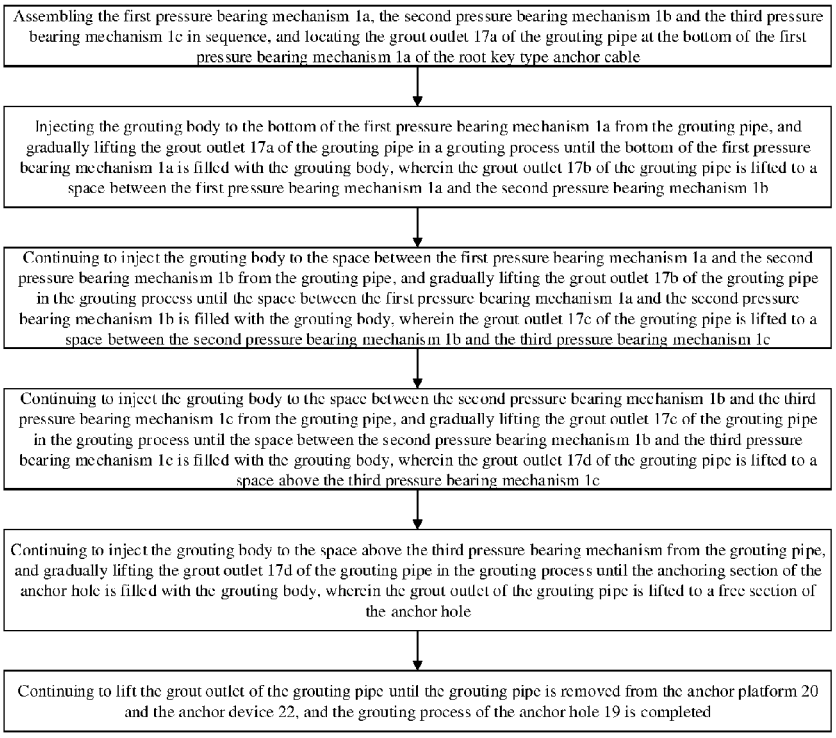
FIG. 19 is a flowchart of steps of an anchor hole grouting method provided by embodiment 2 of the present invention.

Referring to FIG. 18, the assembly method of the pressure bearing mechanism includes the following steps:

inserting the root key 3 into the taper hole in such a manner that the head of the root key 3 faces to the wall of the anchor hole and the tail of the root key 3 faces to the taper hole 7; and plugging the tapered plug 10 into the taper hole 7 from one end having a smaller diameter, wherein the tapered plug 10 occupies an accommodation space of the taper hole 7 to force the root key 3 to further head for the interior of the rock mass, so as to stretch into the rock mass of the anchor hole 19. In the case that the blocking part 30 is arranged on the root key 3, the root key 3 is internally plugged into the key hole at one end of the tail 5 from the outer wall of the carrier 2.

As a specific implementation of the pressure bearing mechanisms 1*a*, 1*b*, 1*c*, a plurality of hanging holes are formed in the pressure bearing mechanisms 1*a*, 1*b*, 1*c*, and the hanging ends of the reinforcement bodies 15*a*, 15*b*, 15*c* penetrate through the hanging holes.

With the third pressure bearing mechanism 1*a* as an example, the root key type anchor cable provided by the embodiment further includes an extrusion anchor device 16*a*, the reinforcement body 15*a* has a remaining part at the bottom of the pressure bearing mechanism 1*a*, the extrusion anchor device 16*a* is fixedly connected with the remaining part, and the outside diameter of the extrusion anchor device 16*a* is larger than the diameter of the hanging hole. In this case, since the outside diameter of the extrusion anchor device 16*a* is larger than the diameter of the hanging hole, the extrusion anchor device 16*a* cannot penetrate through the hanging hole, so that the pressure bearing mechanism 1*a* can be prevented from dropping from the reinforcement body 15*a*.

In the embodiment, as a specific implementation of the connection between the extrusion anchor device 16*a* and the reinforcement body 15*a*, the extrusion anchor device 16*a* is fixedly connected with the remaining part by welding or buckling.

In the embodiment, the bottom of the anchor platform 20 is an inclined plane 21. In this case, the anchor platform 20 conform to the gradient of a slope through the inclined plane 21 at the bottom, an anchoring function can be achieved just by drilling a vertical or horizontal anchor hole 19 in the slope, because the vertical hole or the horizontal hole forms an inclination angle with the slope, so the bottom of the anchor platform 20 is set as the inclined plane 21 to facilitate the application of the anchor cable.

In the embodiment, three pressure bearing mechanisms 1*a*, 1*b*, 1*c* are arranged in parallel. In this case, it can be guaranteed that the first pressure bearing mechanism 1*a* is horizontally arranged, the space between the first pressure bearing mechanism 1*a* and the second pressure bearing mechanism 1*b* is a parallel space, the space between the second pressure bearing mechanism 1*b* and the third pressure bearing mechanism 1*c* is a parallel space, when stress analysis is carried out, the consistency of stress directions of the first pressure bearing mechanism 1*a*, the second pressure bearing mechanism 1*b* and the third pressure bearing mechanism 1*c* can be guaranteed.

Figure 10:
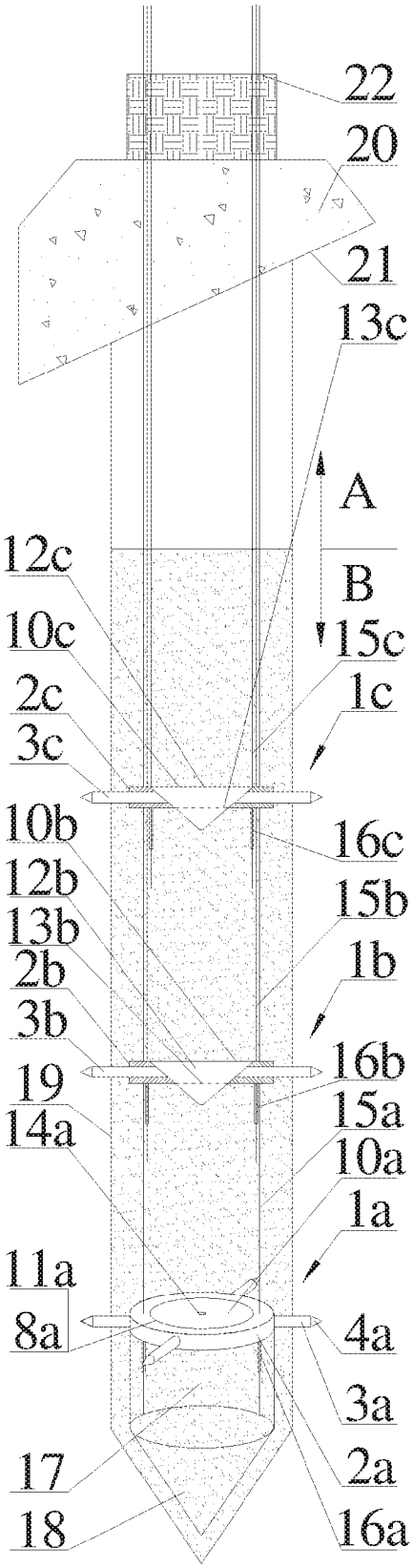
FIG. 10 is a structural schematic diagram of the root key type anchor cable provided by embodiment 1 of the present invention, after the grouting pipe and an anchor device are removed and an anchor hole grouting process is completed.

Referring to FIG. 10 to FIG. 12, in the embodiment, a plurality of hanging holes are uniformly distributed on one circumference of the pressure bearing mechanisms 1*a*, 1*b*, 1*c*. In this case, since the plurality of hanging holes are uniformly distributed on the pressure bearing mechanisms 1*a*, 1*b*, 1*c*, the stress points of the reinforcement bodies 15*a*, 15*b*, 15*c* can be uniform, and thus the pressure bearing mechanisms 1*a*, 1*b*, 1*c* can be prevented from inclining Referring to FIG. 1 to FIG. 8, in the embodiment, the root key type anchor cable further includes a position indicating mechanism, and the position indicating mechanism is used for indicating the positions of the pressure bearing mechanisms 1*a*, 1*b*, 1*c* in the anchor hole 19.

In the embodiment, the position indicating mechanism is a guide cap 18, and the guide cap 18 is fixedly connected to the bottom of the bottommost pressure bearing mechanism 1*a*. Since the relative positions between the three pressure bearing mechanisms 1*a*, 1*b*, 1*c* are fixed, after the position of one pressure bearing mechanism 1*a* is indicated, it is equivalent that the positions of the three pressure bearing mechanisms 1*a*, 1*b*, 1*c* are determined. During construction, the drilling position of the anchor hole 19 is deeper in general, after the guide cap 18 is adopted, blind drill of the pressure bearing mechanisms 1*a*, 1*b*, 1*c* can be avoided, and the positions of the pressure bearing mechanisms 1*a*, 1*b*, 1*c* are determined.

In the embodiment, the pointed end of the anchor hole 19 is in the shape of a first taper, the top end of the guide cap 18 is in the shape of a second taper, and the first taper corresponds to the second taper. In this case, the second taper of the guide cap 18 can adapt to the first taper of the anchor hole 19, so as to accurately locate the position of the first pressure bearing mechanism 1*a*.

In the embodiment, the position indicating mechanism can also be a first displacement sensor (not shown in the figures), and the first displacement sensor (not shown in the figures) is used for detecting the displacement data of the pressure bearing mechanisms 1*a*, 1*b*, 1*c* in the anchor hole 19. In this case, the guide cap 18 does not need to be arranged on the first pressure bearing mechanism 1*a*, the downward walking displacement of the pressure bearing mechanisms 1*a*, 1*b*, 1*c* from the opening of the anchor hole 19 can be detected by the first displacement sensor (not shown in the figures), and thus the positions of the pressure bearing mechanisms 1*a*, 1*b*, 1*c* in the anchor hole 19 can be accurately located. The root key type anchor cable further includes a first remote interface and terminal equipment, the first remote interface is formed in the first displacement sensor (not shown in the figures), the first displacement sensor (not shown in the figures) transmits the detected displacement data to the terminal equipment through the first remote interface, and the terminal equipment is selected from multiple devices in the group consisting of a PC, a singlechip and a handheld terminal. In this case, the position of the first displacement sensor (not shown in the figures) in the anchor hole 19 can be acquired by the terminal equipment, so that the application is more convenient.

The root key type anchor cable further includes an alarm device, the alarm device is used for indicating whether the pressure bearing mechanisms 1*a*, 1*b*, 1*c* are in place, and when the pressure bearing mechanisms 1*a*, 1*b*, 1*c* are in place, the alarm device sends an alarm signal. In this case, when the root key type anchor cable provided by the embodiment is conveyed into the anchor hole 19, there is no need to monitor whether the pressure bearing mechanisms 1*a*, 1*b*, 1*c* are in place, and whether the pressure bearing mechanisms 1*a*, 1*b*, 1*c* are in place can be acquired just through the alarm signal acquired from the alarm device.

The root key type anchor cable further includes a second displacement sensor (not shown in the figures), and the second displacement sensor (not shown in the figures) is used for indicating the displacement data of grout outlets 17 (17*a*, 17*b*, 17*c*, 17*d*) of the grouting pipe in the anchor hole 19. In this case, when the grouting pipe is guided into the anchor hole 19 from the through hole, the second displacement sensor (not shown in the figures) can be used for indicating the operation positions of the grout outlets 17 (17*a*, 17*b*, 17*c*, 17*d*) of the grouting pipe in the anchor hole 19, so as to conveniently acquire the specific positions of the grout outlets of the grouting pipe in the anchor hole 19. The root key type anchor cable further includes a second remote interface and terminal equipment, the second remote interface is formed in the second displacement sensor (not shown in the figures), the second displacement sensor (not shown in the figures) transmits the detected displacement data to the terminal equipment through the second remote interface, and the terminal equipment is selected from multiple devices in the group consisting of the PC, the singlechip and the handheld terminal. In this case, the position of the second displacement sensor (not shown in the figures) in the anchor hole 19 can be acquired by the terminal equipment, so that the application is more convenient.

The root key type anchor cable further includes a pipe retrieval car (not shown in the figures) of the grouting pipe, a grout inlet of the grouting pipe is fixedly connected to the pipe retrieval car (not shown in the figures), in a grouting process of the anchor hole 19, the pipe retrieval car (not shown in the figures) is used for retrieving the grouting pipe, so that the grout outlet of the grouting pipe is lifted. In this case, the pipe retrieval action of the grouting pipe can be completed by the pipe retrieval car (not shown in the figures) without manual pipe retrieval.

In the embodiment, the root key type anchor cable further includes a speed setting device of the pipe retrieval car (not shown in the figures), the speed setting device of the pipe retrieval car (not shown in the figures) is used for setting the running speed of the pipe retrieval car (not shown in the figures), the operation formula of the running speed of the pipe retrieval car (not shown in the figures) is $v_{car}=v_{entry}\times S_{pipe}/S_{hole}$, wherein $v_{car}$ represents the running speed of the pipe retrieval car (not shown in the figures), $v_{entry}$ represents the flow speed of grout in the grouting pipe, $S_{pipe}$ represents the sectional area of the grouting pipe, and $S_{hole}$ represents the sectional area of the anchor hole 19. In this case, the running speed of the pipe retrieval car (not shown in the figures) can be set according to the flow speed of grout in the grouting pipe, so that the grout outlet of the grouting pipe is always above the grout surface of the grouting body. The root key type anchor cable further includes a flow speed measuring instrument (not shown in the figures), the flow speed measuring instrument (not shown in the figures) is used for measuring real-time flow speed data of the grout in the grouting pipe, and the speed setting device sets the running speed of the pipe retrieval car (not shown in the figures) according to the real-time flow speed data.

In addition, when the grout is output from a grout conveying device (not shown in the figures), the flow speed of the grout in the grouting pipe is set by the grout conveying device (not shown in the figures), and the speed setting device sets the running speed of the pipe retrieval car (not shown in the figures) according to the set flow speed of the grout.

Embodiment 2

Referring to FIG. 2 to FIG. 10 and FIG. 19, the anchor hole grouting method provided by embodiment 2 of the present invention is achieved on the basis of the root key type anchor cable provided by the present invention, three pressure bearing mechanisms are used for illustration, a plurality of pressure bearing mechanisms of the root key type anchor cable sequentially include a first pressure bearing mechanism 1*a*, a second pressure bearing mechanism 1*b* and a third pressure bearing mechanism 1*c* from bottom to top, and the anchor hole grouting method includes the following steps: assembling the first pressure bearing mechanism 1*a*, the second pressure bearing mechanism 1*b* and the third pressure bearing mechanism 1*c* in sequence, and locating the grout outlet 17*a* of the grouting pipe at the bottom of the first pressure bearing mechanism 1*a;* injecting the grouting body to the bottom of the first pressure bearing mechanism 1*a* from the grouting pipe, and gradually lifting the grout outlet 17*a* of the grouting pipe in a grouting process until the bottom of the first pressure bearing mechanism 1*a* is filled with the grouting body, wherein the grout outlet 17*b* of the grouting pipe is lifted to a space between the first pressure bearing mechanism 1*a* and the second pressure bearing mechanism 1*b;* continuing to inject the grouting body to the space between the first pressure bearing mechanism 1*a* and the second pressure bearing mechanism 1*b* from the grouting pipe, and gradually lifting the grout outlet 17*b* of the grouting pipe in the grouting process until the space between the first pressure bearing mechanism 1*a* and the second pressure bearing mechanism 1*b* is filled with the grouting body, wherein the grout outlet 17*c* of the grouting pipe is lifted to a space between the second pressure bearing mechanism 1*b* and the third pressure bearing mechanism 1*c;* continuing to inject the grouting body to the space between the second pressure bearing mechanism 1*b* and the third pressure bearing mechanism 1*c* from the grouting pipe, and gradually lifting the grout outlet 17*c* of the grouting pipe in the grouting process until the space between the second pressure bearing mechanism 1*b* and the third pressure bearing mechanism 1*c* is filled with the grouting body, wherein the grout outlet 17*d* of the grouting pipe is lifted to a space above the third pressure bearing mechanism 1*c;* continuing to inject the grouting body to the space above the third pressure bearing mechanism from the grouting pipe, and gradually lifting the grout outlet 17*d* of the grouting pipe in the grouting process until the anchoring section of the anchor hole 19 is filled with the grouting body, wherein the grout outlet of the grouting pipe is lifted to a free section of the anchor hole 19; and continuing to lift the grout outlet of the grouting pipe until the grouting pipe is removed from the anchor platform 20 and the anchor device 22, and the grouting process of the anchor hole 19 is completed.

According to the anchor cable grouting method achieved on the basis of the root key type anchor cable provided by embodiment 2 of the present invention, after the grouting process of the anchor hole 19 is completed, since the three pressure bearing mechanisms 1*a*, 1*b*, 1*c* are provided with the plurality of root keys 3*a*, 3*b*, 3*c* which can stretch into the rock mass of the anchor hole 19, the effective bearing areas of the pressure bearing mechanisms 1*a*, 1*b*, 1*c* actually exceed the areas of the upper surfaces thereof, meanwhile, the root keys 3*a*, 3*b*, 3*c* generate interactive forces with the rock mass in the anchor hole 19, therefore the resistance of the anchoring section can be improved, and accordingly after the anchor hole grouting engineering is completed by adopting the anchor cable and the grouting method provided by embodiment 2 of the present invention, the anchoring effect of the anchor cable can be effectively improved.

Referring to FIG. 2*a*, FIG. 3*a*, FIG. 4*a* and FIG. 5*a*, the grouting pipe is mounted after the first pressure bearing mechanism 1*a*, the second pressure bearing mechanism 1*b* and the third pressure bearing mechanism 1*c* are entirely assembled, the grouting pipe is inserted into a first through hole, a second through hole and a third through hole in the centers of the first pressure bearing mechanism 1*a*, the second pressure bearing mechanism 1*b* and the third pressure bearing mechanism 1*c*, so the grout outlet 17*a* of the grouting pipe is located at the bottom of the first pressure bearing mechanism 1*a*. The method has higher requirements on the alignment of the first through hole, the second through hole and the third through hole and on the grouting pipe, and it must be guaranteed that the first through hole, the second through hole and the third through hole are aligned and that the grouting pipe must be completely smooth in the insertion process.

Referring to FIG. 2*b*, FIG. 3*b*, FIG. 4*b* and FIG. 5*b*, the grouting pipe is mounted after the first pressure bearing mechanism 1*a* is assembled, and when the second pressure bearing mechanism 1*b* and the third pressure bearing mechanism 1*c* are sequentially assembled subsequently, the grout outlet 17*a* of the grouting pipe is always located at the bottom of the first pressure bearing mechanism 1*a*. In this case, the second tapered plug and the third tapered plug need to be plugged into the taper hole before penetrating through the grouting pipe, which requires the operation of a specialist.

Although the preferred embodiments of the present invention have been described, those skilled in the art can make additional changes and modifications to these embodiments once mastering the basic creative concepts. Therefore, the appended claims are intended to be interpreted as including the preferred embodiments and all the changes and modifications that fall within the scope of the present invention.

Apparently, those skilled in the art can make various modifications and variations to the present invention without departing from the spirit and scope of the present invention. Accordingly, if these modifications and variations of the present invention belong to the scope of the claims of the present invention and the equivalent technology thereof, the present invention is intended to encompass these modifications and variations.

The invention claimed is:

1. A root key type pressure bearing mechanism in an anchor hole, comprising a carrier, root keys and a tapered plug, wherein a through hole is formed in the center of the tapered plug, a taper hole is formed in the center of the carrier, key holes are formed along a radial direction of the carrier with an inner wall of the taper hole as a starting point, and the number of the key holes is the same as that of the root keys, the root keys and the key holes constitute sliding pairs, an outer wall of the tapered plug is adapted to the taper hole, the sum of the length of the root key and the radius of a position corresponding to the tapered plug is larger than the radius of the anchor hole, and the length of the root key is less than the radius of the anchor hole; and an anchor device is fixedly connected to an anchor platform to constitute an outer anchoring section, a plurality of pressure bearing mechanisms are respectively connected with multiple groups of reinforcement bodies in series, fixing ends of the reinforcement bodies are respectively connected to an outer anchoring section in parallel, hanging ends of the reinforcement bodies are used for hanging the pressure bearing mechanisms, the plurality of pressure bearing mechanisms are externally provided with a plurality of root keys which can stretch into a rock mass of an anchor hole along the radial direction, through holes are formed in the centers of the plurality of pressure bearing mechanisms, circle centers of the through holes are located on the same straight line, the diameters of the through holes are the same, a punch hole is reserved in the outer anchoring section, the punch hole is located on the same straight line as the circle centers of the through holes, the diameter of the punch hole is the same as the diameters of the through holes, a grouting pipe penetrates through the punch hole and the through holes, and the grouting pipe constitutes sliding pairs with the pressure bearing mechanisms and the outer anchoring section, when the tapered plug is plugged into the taper hole, the head of the root key stretches into a rock mass of the anchor hole.

2. The root key type pressure bearing mechanism in the anchor hole of claim 1, wherein the diameter of the top of the tapered plug is larger than the diameter of the bottom of the taper hole, and when the tapered plug is plugged into the taper hole, the tapered plug is overlapped with a key hole; or, wherein the diameter of the top of the tapered plug is not less than the diameter of the top of the taper hole, and when the tapered plug is plugged into the taper hole, the tapered plug is overlapped with the key hole.

3. The root key type pressure bearing mechanism in the anchor hole of claim 1, wherein the shape of a tail of the root key is adapted to the shape of the outer wall of the tapered plug, and thus the tail of the root key and the outer wall of the tapered plug form surface contact.

4. The root key type pressure bearing mechanism in the anchor hole of claim 1, wherein the root key is fixedly connected with a blocking part at a contact site with the outer wall of the carrier; wherein the blocking part is made of a flexible material.

5. A root key type anchor cable of claim 1, wherein a plurality of hanging holes are formed in the pressure bearing mechanism, and the hanging ends of the reinforcement bodies penetrate through the hanging holes.

6. The root key type anchor cable of claim 5, the root key type anchor cable further comprising an extrusion anchor device, wherein the reinforcement body has a remaining part at the bottom of the pressure bearing mechanism, the extrusion anchor device is fixedly connected with the remaining part, and the outside diameter of the extrusion anchor device is larger than the diameter of the hanging hole.

7. The root key type anchor cable of claim 5, wherein the plurality of hanging holes are uniformly distributed on one circumference of the pressure bearing mechanism.

8. The root key type anchor cable of claim 5, further comprising a position indicating mechanism, wherein the position indicating mechanism is used for indicating the position of the pressure bearing mechanism in the anchor hole.

9. The root key type anchor cable of claim 8, wherein the position indicating mechanism is a guide cap, and the guide cap is fixedly connected to the bottom of the bottommost pressure bearing mechanism; or, wherein the position indicating mechanism is a first displacement sensor, and the first displacement sensor is used for detecting the displacement data of the pressure bearing mechanism in the anchor hole.

10. The root key type anchor cable of claim 9, wherein the position indicating mechanism is a guide cap, and the guide cap is fixedly connected to the bottom of the bottommost pressure bearing mechanism;

wherein the pointed end of the anchor hole is in the shape of a first taper, the top end of the guide cap is in the shape of a second taper, and the first taper corresponds to the second taper.

11. The root key type anchor cable of claim 9, wherein the position indicating mechanism is a first displacement sensor, and the first displacement sensor is used for detecting the displacement data of the pressure bearing mechanism in the anchor hole;

the root key type anchor cable further comprising a first remote interface and terminal equipment, wherein the first remote interface is formed in the first displacement sensor, the first displacement sensor transmits the detected displacement data to the terminal equipment through the first remote interface, and the terminal equipment is selected from multiple devices in the group consisting of a PC, a singlechip and a handheld terminal.

12. The root key type anchor cable of claim 11, the root key type anchor cable further comprising an alarm device, wherein the alarm device is used for indicating whether the pressure bearing mechanism is in place, and when the pressure bearing mechanism is in place, the alarm device sends an alarm signal.

13. The root key type anchor cable of claim 5, the root key type anchor cable further comprising a second displacement sensor, wherein the second displacement sensor is used for indicating the displacement data of the grout outlet of the grouting pipe in the anchor hole.

14. The root key type anchor cable of claim 13, the root key type anchor cable further comprising a second remote interface and terminal equipment, wherein the second remote interface is formed in the second displacement sensor, the second displacement sensor transmits the detected displacement data to the terminal equipment through the second remote interface, and the terminal equipment is selected from multiple devices in the group consisting of the PC, the singlechip and the handheld terminal.

15. The root key type anchor cable of claim 5, the root key type anchor cable further comprising a pipe retrieval car of the grouting pipe, wherein a grout inlet of the grouting pipe is fixedly connected to the pipe retrieval car, in a grouting process of the anchor hole, the pipe retrieval car is used for retrieving the grouting pipe, so that the grout outlet of the grouting pipe is lifted.

16. An anchor hole grouting method, wherein the anchor hole grouting method is achieved on the basis of the root key type anchor cable of claim 5, the plurality of pressure bearing mechanisms sequentially comprise a first pressure bearing mechanism, a second pressure bearing mechanism, a third pressure bearing mechanism, . . . and an $N^{th}$ pressure bearing mechanism from bottom to top, and the anchor hole grouting method comprises the following steps:

assembling the first pressure bearing mechanism, the second pressure bearing mechanism, the third pressure bearing mechanism, . . . and the $N^{th}$ pressure bearing mechanism in sequence, and locating a grout outlet of the grouting pipe at the bottom of the first pressure bearing mechanism;

injecting a grouting body to the bottom of the first pressure bearing mechanism from the grouting pipe, and gradually lifting the grout outlet of the grouting pipe in a grouting process until the bottom of the first pressure bearing mechanism is filled with the grouting body, wherein the grout outlet of the grouting pipe is lifted to a space between the first pressure bearing mechanism and the second pressure bearing mechanism;

continuing to inject the grouting body to the space between the first pressure bearing mechanism and the second pressure bearing mechanism from the grouting pipe, and gradually lifting the grout outlet of the grouting pipe in the grouting process until the space between the first pressure bearing mechanism and the second pressure bearing mechanism is filled with the grouting body, wherein the grout outlet of the grouting pipe is lifted to a space between the second pressure bearing mechanism and the third pressure bearing mechanism;

continuing to inject the grouting body to the space between the second pressure bearing mechanism and the third pressure bearing mechanism from the grouting pipe, and gradually lifting the grout outlet of the grouting pipe in the grouting process until the space between the second pressure bearing mechanism and the third pressure bearing mechanism is filled with the grouting body, wherein the grout outlet of the grouting pipe is lifted to a space above the third pressure bearing mechanism;

repeating the operation until the space between the $(N-1)^{th}$ pressure bearing mechanism and the $N^{th}$ pressure bearing mechanism is filled with the grouting body, wherein the grout outlet of the grouting pipe is lifted to a space above the $N^{th}$ pressure bearing mechanism;

continuing to inject the grouting body to the space above the $N^{th}$ pressure bearing mechanism, and gradually lifting the grout outlet of the grouting pipe in the grouting process until the anchoring section of the anchor hole is filled with the grouting body, wherein the grout outlet of the grouting pipe is lifted to a free section of the anchor hole; and continuing to lift the grout outlet of the grouting pipe until the grouting pipe is removed from the anchor platform and the anchor device, and the grouting process of the anchor hole is completed.

17. The anchor hole grouting method of claim 16, wherein the grouting pipe is mounted after the first pressure bearing mechanism, the second pressure bearing mechanism, the third pressure bearing mechanism, . . . and the $N^{th}$ pressure bearing mechanism are entirely assembled, and the grouting pipe is inserted into a first through hole, a second through hole, a third through hole, . . . and the $N^{th}$ through hole in the centers of the first pressure bearing mechanism, the second pressure bearing mechanism, the third pressure bearing mechanism, . . . and the $N^{th}$ pressure bearing mechanism, and the grout outlet of the grouting pipe is located at the bottom of the first pressure bearing mechanism; or, wherein the grouting pipe is mounted after the first pressure bearing mechanism is assembled, and when the second pressure bearing mechanism, the third pressure bearing mechanism, . . . and the $N^{th}$ pressure bearing mechanism are sequentially assembled subsequently, the grout outlet of the grouting pipe is always located at the bottom of the first pressure bearing mechanism.

* * * * *